US008776697B1

(12) United States Patent
O'Connell

(10) Patent No.: US 8,776,697 B1
(45) Date of Patent: Jul. 15, 2014

(54) PALLET WITH TINE SUPPORT ELEMENTS

(71) Applicant: Brian O'Connell, Huntersville, NC (US)

(72) Inventor: Brian O'Connell, Huntersville, NC (US)

(73) Assignee: Intrek Logistics LLC, Huntersville, NC (US)

( * ) Notice: Subject to any disclaimer, the term of this patent is extended or adjusted under 35 U.S.C. 154(b) by 0 days.

(21) Appl. No.: 14/218,161

(22) Filed: Mar. 18, 2014

(51) Int. Cl.
*B65D 19/00* (2006.01)

(52) U.S. Cl.
CPC .... *B65D 19/004* (2013.01); *B65D 2519/00268* (2013.01)
USPC ..... 108/51.11

(58) Field of Classification Search
USPC ..... 108/51.11, 51.3, 57.25; 248/346.02; 206/386
See application file for complete search history.

(56) References Cited

U.S. PATENT DOCUMENTS

| | | | | | |
|---|---|---|---|---|---|
| 4,550,830 | A * | 11/1985 | Shuert | 108/55.1 |
| D400,681 | S * | 11/1998 | Sadr | D34/38 |
| 5,868,080 | A * | 2/1999 | Wyler et al. | 108/57.25 |
| 5,890,437 | A * | 4/1999 | Hill | 108/51.3 |
| 6,167,817 | B1 * | 1/2001 | Liu | 108/51.11 |
| 7,086,339 | B2 * | 8/2006 | Apps et al. | 108/57.25 |
| 7,107,912 | B2 * | 9/2006 | Schutz | 108/55.1 |
| D548,924 | S | 8/2007 | Frankenberg | |
| 7,293,509 | B2 | 11/2007 | Hassell | |
| 7,557,714 | B2 * | 7/2009 | Roeder et al. | 340/572.7 |
| 7,735,430 | B2 * | 6/2010 | Muirhead | 108/57.25 |
| 8,141,500 | B2 | 3/2012 | Naidu et al. | |
| 8,282,111 | B2 | 10/2012 | Hailston et al. | |
| 8,291,839 | B2 | 10/2012 | Apps et al. | |
| D682,503 | S * | 5/2013 | Fehrman et al. | D34/38 |
| 8,511,239 | B2 * | 8/2013 | Lin | 108/57.25 |
| 2003/0189152 | A1 * | 10/2003 | Elder et al. | 108/51.11 |
| 2010/0095875 | A1 | 4/2010 | Hailston et al. | |
| 2010/0295261 | A1 | 11/2010 | Ellington | |
| 2011/0171000 | A1 | 7/2011 | Hailston | |
| 2012/0319063 | A1 | 12/2012 | Hailston et al. | |
| 2013/0136573 | A1 * | 5/2013 | Berry et al. | 108/57.25 |
| 2013/0202400 | A1 | 8/2013 | Richard et al. | |

* cited by examiner

*Primary Examiner* — Jose V Chen
(74) *Attorney, Agent, or Firm* — Patentfile, LLC; Bradley C. Fach; Steven R. Kick

(57) ABSTRACT

An improved pallet comprising: a support deck with an upper load contacting surface and a lower ground facing surface; a first and second sidewall, each with ground contacting legs and each connected to two elongate sides of the support deck; a pallet cavity formed below said lower ground facing surface of the support deck and between said first and second sidewalls; and a support element with a tine contacting surface protruding vertically down from the lower ground facing surface of the support deck partially into the pallet cavity but not below the ground contacting legs of the first and second sidewalls.

20 Claims, 15 Drawing Sheets

PALLET WITH TINE SUPPORT ELEMENTS

FIELD OF THE INVENTION

The present invention relates to the field of material transporting equipment and devices. More specifically, the invention relates to improved pallets for use with transporting devices such pallet jacks as forklifts.

BACKGROUND

Pallets are commonly used to secure durable goods during transport between various locations. Typically, a pallet comprises a square or rectangular load bearing surface or deck configured to receive goods for storage and transport. Sidewalls with ground contacting legs extend vertically below the deck forming a space or cavity suitable to engage various types of pallet transporting equipment such as hand pallet trucks, Walkie Pallet Jacks, forklifts, and the like. Pallet transportation equipment commonly includes two elongated forks known as "tines" which are inserted under the pallet deck and into the pallet cavity to raise the pallet off of the ground for transportation.

Recently, pallets with narrow elongated decks and high profile designs have become common place. These high profile pallets may have support decks which are 6 inches or higher above the ground. While advantageous in certain environments, the high profile design of these new pallets pose an inherent design issue that prevents them from being universally engaged and moved with standard warehouse material handling equipment. Narrow high profile design (HPD) pallets currently available can only accept warehouse material handling equipment that has been modified with attachments or adapters leading to added expenses and a loss in operation efficiencies. Some pallet transport operators may attempt to partially insert a single tine using traditional warehouse material handling equipment partially under a HPD pallet resulting in unsafe handling practices which is both dangerous and potentially costly to the distributor.

Another challenge for HPD pallet transport arises due to the inability to properly engage a HPD pallet from the lateral side as the equipment operator is often not able to gauge the appropriate depth of the lift tines into and through the pallet cavity. In these situations, it is common for the lift operator to engage and lift a pallet with the tines only partially through the pallet thus causing the pallet to be raised at an awkward angle which may damage or break the pallet and may even cause the contents on the pallet deck to fall.

Therefore, a need exists for improved pallets that are able to engage with traditional pallet transportation devices without the need for attachments or adapters. There is a further need for improved pallets that are able to accept standard tine and narrow tine warehouse handling equipment from all four sides.

BRIEF SUMMARY OF THE INVENTION

It is one object of the present invention to provide a novel improved pallet that is able to accept tines from traditional warehouse material handling equipment without the need for attachments or adapters. It is further an object of the present invention, in some embodiments, to provide a novel improved pallet that is able to accept standard horizontal tines and narrow vertical tines from warehouse material handling equipment through standard tine access openings and new and novel narrow tine vertical openings respectively.

In preferred embodiments, the improved pallet comprises: a support deck with an upper load contacting surface and a lower ground facing surface; a first and second sidewall, each with ground contacting legs, connected to two elongate sides of the support deck; a pallet cavity formed below said lower ground facing surface of the support deck and between said first and second sidewalls; and a support element with a tine contacting surface protruding vertically down from the lower ground facing surface of the support deck partially into the pallet cavity but not below the ground contacting legs of the first and second sidewalls.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New improved pallets and narrow pallet transporting devices are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figures 1, 1A:
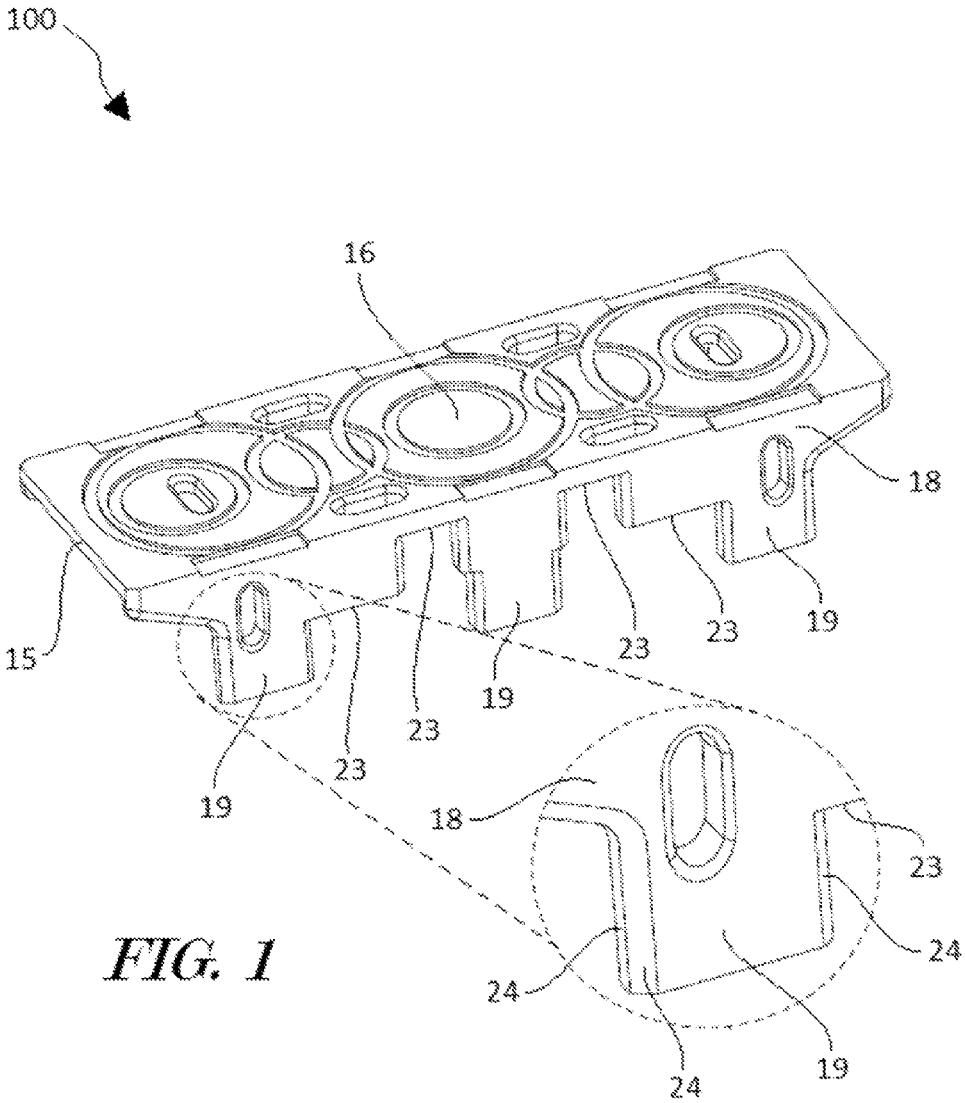
FIG. 1 depicts a top perspective view of an example of an improved pallet according to various embodiments described herein.
FIG. 1A shows a magnified perspective view of a sidewall ground contacting leg with chamfered edges.
Figure 2:
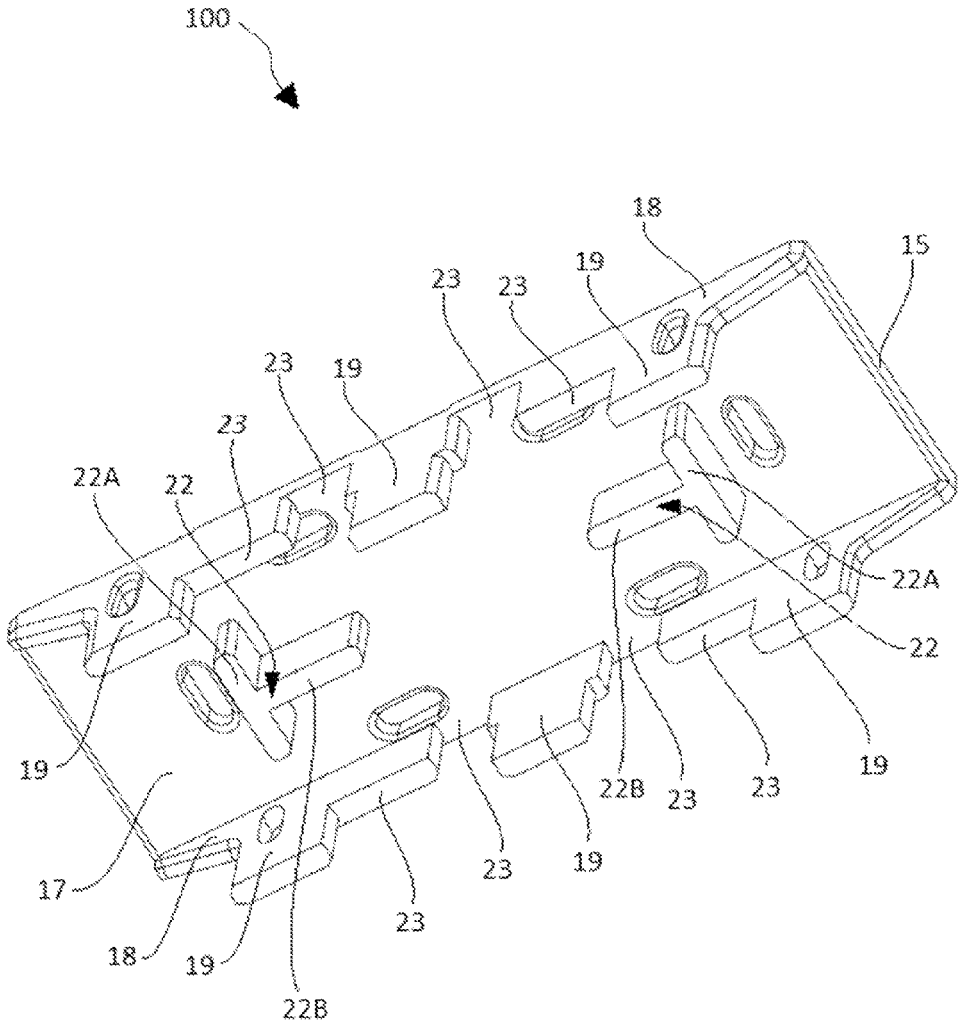
FIG. 2 illustrates a bottom perspective view of an example of an improved pallet according to various embodiments described herein.

The present invention will now be described by example and through referencing the appended figures representing preferred and alternative embodiments. FIG. 1 and FIG. 2 illustrate an example of an improved pallet ("the pallet") 100 according to various embodiments of the present invention. In preferred embodiments, the pallet 100 is of a high profile design with a load bearing support deck raised higher off the ground than a traditional standard pallet commonly found in the field. In some embodiments, a high profile pallet 100 has a lower ground facing surface 17 (FIG. 2) that is generally greater than 6 inches off the ground creating a pallet cavity 21 (FIG. 4) with a height of at least 6 inches while traditional or standard pallets may typically have a pallet cavity with a height of between 5 to 6 inches. In this example, the pallet 100 comprises a support deck 15 with an upper load contacting surface 16 and a lower ground facing surface 17. The support deck 15 is substantially rectangular in shape and comprises two opposing ends and parallel elongate sides. In the examples shown, the two opposing ends of the support deck 15 and parallel elongate sides of the support deck 15 are perpendicularly arranged to each other.

In this and preferred embodiments, first and second sidewalls 18 are joined to both of the opposite elongate sides (sometimes called lateral sides) of the support deck 15. Each sidewall 18 preferably comprises one or more ground contacting legs 19. In the example shown, each sidewall 18 comprises three ground contacting legs 19 positioned on each elongate side of the support deck 15. In some embodiments, the pallet 100 may comprise two, three four, five, six, seven, eight, nine, or even ten or more ground contacting legs 19. In some alternative embodiments, first and second sidewalls 18 may be positioned at opposing non-elongated sides of the pallet 100. In yet further alternative embodiments, first and second sidewalls 18 and third and fourth sidewalls 18 may be positioned along all four sides of the pallet 100.

Figure 4:
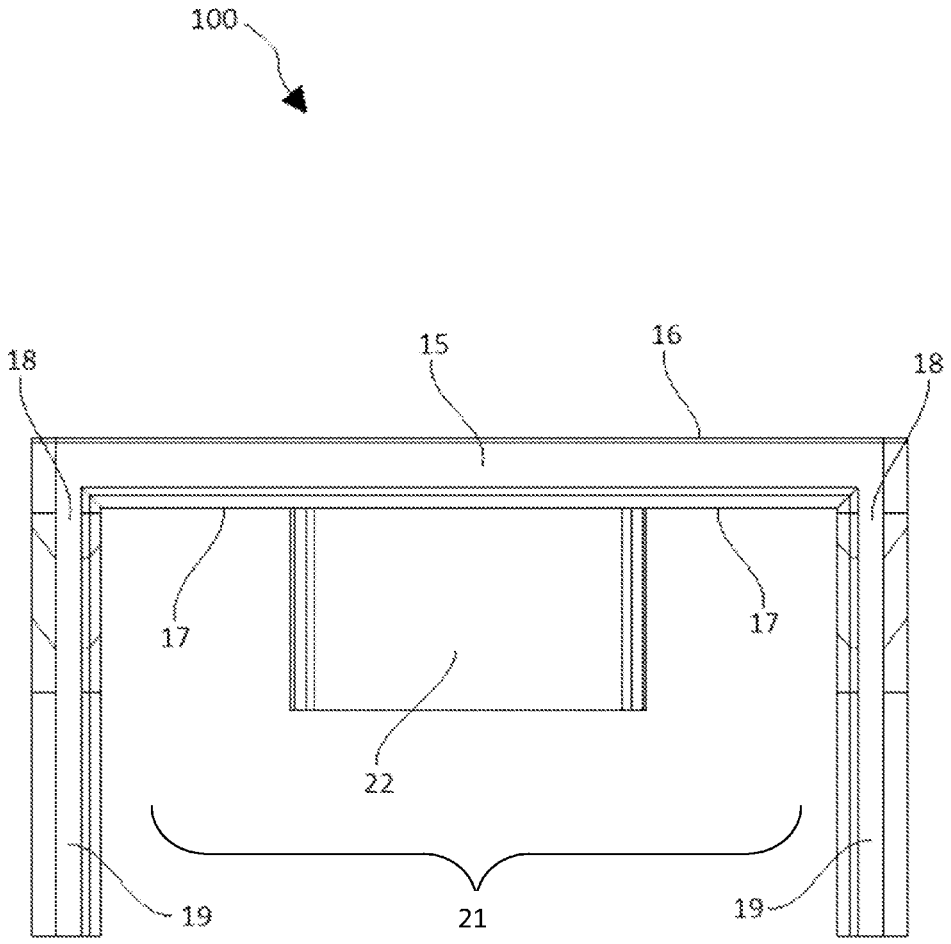
FIG. 4 depicts an elevation view of an end of an example of an improved pallet according to various embodiments described herein.

As perhaps best shown in the magnified view of a ground contacting leg 19 of FIG. 1A, in preferred embodiments, the ground contacting legs 19 may be configured with one or more chamfered edges 24 which may be substantially rounded or angled to facilitate guiding the tines of a pallet transporting device into and through the pallet cavity 21 (FIG. 4). In some embodiments, instead of chamfered edges 24, the pallet 100 may comprise angled edges, tapered edges, round edges, or even traditional square edges. The chamfered edges 24 are preferably located on lateral sides of the tine access openings and not on the upper tine support edges 23.

The two sidewalls 18 also comprise a plurality of tine support edges 23 which are configured to receive and support the pallet 100 on a pallet transporting device. In preferred embodiments, the sidewalls 18 comprise two wider spaced tine support edges 23 and two narrower spaced tine support edges 23 allowing for engagement with pallet transporting devices with different tine sizes and shapes. Also in preferred embodiments, the lower ground facing surface 17 may contact one or more tines of a narrow tine pallet transporting device 300 (FIG. 12) thereby performing the same function as a tine support edge 23.

An open space or pallet cavity 21 is formed generally between the lower ground facing surface 17 of the support deck 15, the two sidewalls 18, and in some cases the ground surface or another pallet 100 upon which the ground contacting legs 19 may rest. The pallet cavity 21 allows one or more tines from a pallet transporting device to be inserted under the pallet 100 so that the tines may contact two or more tine support edges 23 or the lower ground facing surface 17 allowing for substantially level transport of a pallet 100 by a pallet transporting device. The ground contacting legs 19 are configured to keep the support deck 15 in a substantially level orientation before and after engagement of a pallet 100 with a pallet transporting device.

As perhaps best shown by FIG. 2, the pallet 100 comprises one or more tine support elements 22 with one or more tine contacting surfaces 22A and 22B. Tine support elements 22 are located within the pallet cavity 21 (FIG. 4) below the support deck 15 and are configured to make contact with lift tines of a pallet transport device. In some embodiments, tine support elements 22 may preferably be positioned on the lower ground contacting surface 17 and configured to protrude vertically down into the pallet cavity 21 from the lower ground facing surface 17 of support deck 15. In preferred embodiments, tine support element 22 comprises a tine contacting surface of a generally planer shape configured engage with a lifting tine of a pallet transport device such as hand pallet trucks, Walkie Pallet Jacks, forklifts, and the like. In some other embodiments, tine support element 22 comprises a tine contacting surface of a generally non-planer shape such as a curved surface, a wavy surface, a surface with peaks and valleys, ridges, grooves, etc. configured to engage with a lifting tine of a pallet transport device such as hand pallet trucks, Walkie Pallet Jacks, forklifts, and the like. In preferred embodiments, each tine support element 22 comprises one or more longitudinal tine contacting surface 22A and may, in some embodiments further comprise one or more lateral tine contacting surface 22B with each tine contacting surface preferably having a planer shape configured to transversally contact one or more tines of a pallet transporting device. In some other embodiments, tine support element 22 comprise tine contacting surfaces 22A and 22B of a generally non-planer shape such as a curved surface, a wavy surface, a surface with peaks and valleys, ridges, grooves, etc. configured to engage with a lifting tine of a pallet transport device such as hand pallet trucks, Walkie Pallet Jacks, forklifts, and the like. In preferred embodiments, the tine support elements 22 are configured to protrude vertically down into the pallet cavity from the lower ground facing surface 17 so that their longitudinal tine contacting surface 22A and/or a lateral tine contacting surface 22B is in the same plane or otherwise level with the wider spaced tine support edges 23 of the standard tine access openings 25 (FIG. 3) within the sidewalls 18. The tine support elements 22 may be "T" shaped, "X" shaped, rectangular, square, cylindrical, cuboidal, or any other geometric or non-geometric shape that is configured to reside within the pallet cavity 21 below the lower ground facing surface 17 to support the pallet 100 when engaged with a lift tine. In some alternative embodiments, tine support elements 22 may be configured within the pallet cavity 21 but not connected to the support deck 21 and may instead be connect to one or more pallet sidewalls 18 or other surfaces of the pallet 100.

Figure 3:
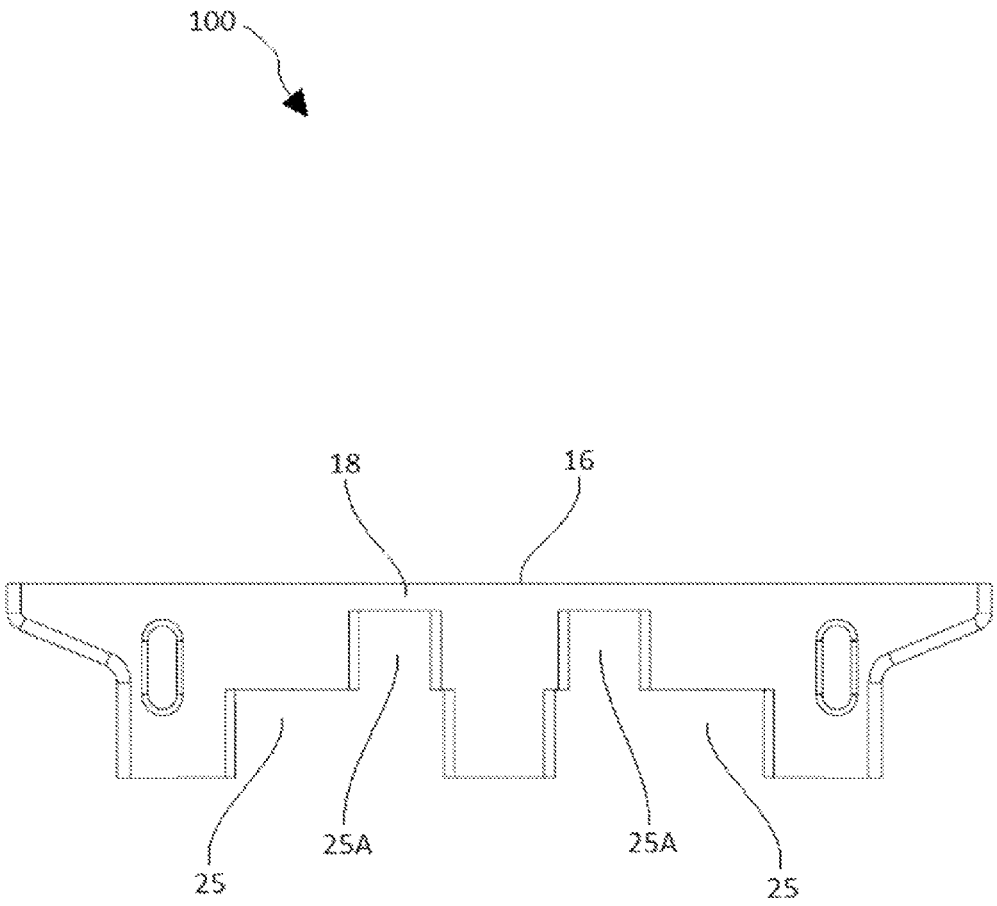
FIG. 3 shows an elevation view of an elongate side of an example of an improved pallet according to various embodiments described herein.

In some alternative embodiments, one or more tine support elements 22 may be configured to protrude vertically down into the pallet cavity 21 from the lower ground facing surface 17 with a longitudinal tine contacting surface 22A and/or a lateral tine contacting surface 22B in the same plane or otherwise level with the narrower spaced tine support edges 23 of the narrow tine vertical openings 25A (FIG. 3).

In the example shown by FIG. 2 and in preferred embodiments, tine support elements 22 may comprise a longitudinal tine contacting surface 22A oriented to provide a planer surface sufficient to transversely contact various portions or a substantial region of a lift tine entering the pallet from a longitudinal direction through one of the opposing ends of the pallet 100. Furthermore, in the example shown by FIG. 2 and in preferred embodiments, tine support elements 22 may comprise a lateral tine contacting surface 22B oriented to provide a planer surface sufficient to transversely contact various portions or a substantial region of a lift tine entering the pallet from a lateral direction for example through a standard tine access opening 25 (FIG. 3) in a sidewall 18. In preferred embodiments, tine support elements 22 may comprise both a longitudinal tine contacting surface 22A oriented to provide a planer surface sufficient to transversely contact various portions or a substantial region of a lift tine entering the pallet from a longitudinal direction through one of the opposing ends of the pallet 100 and a lateral tine contacting surface 22B oriented to provide a planer surface sufficient to transversely contact various portions of a lift tine entering the pallet from a lateral direction for example through a standard tine access opening 25 (FIG. 3) in a sidewall 18. In preferred embodiments, lateral tine contacting surface 22B of said first and second support elements 22 extends vertically down into the pallet cavity 21 to a depth substantially level with tine supporting edges 23 of said first and second standard tine access openings 25. In some alternative embodiments, tine support elements 22 may comprise additional tine contacting surfaces, regions, or sub-units configured to make contact with various portions of a lift tine to support a pallet 100.

In preferred embodiments, longitudinal tine contacting surface 22A and lateral tine contacting surface 22B are integrally formed as a single tine support element 22 unit and are located perpendicularly proximate to each other. In some embodiments, longitudinal tine contacting surface 22A and lateral tine contacting surface 22B of tine support elements 22 are located perpendicularly proximate to each other as two or more sub units (FIG. 13). In other embodiments, longitudinal tine contacting surface 22A and lateral tine contacting surface 22B of tine support elements 22 are located generally proximate to each other as one unit or one or more sub units.

Turning now to FIG. 3, an elevation view of an elongate side of an example of an improved pallet 100 according to various embodiments is shown. In preferred embodiments, the sidewalls 18 of the elongate sides of the pallet 100 comprise one or more standard tine access openings 25 (e.g. first and second standard tine access openings 25) in additional to one or more narrow tine vertical openings 25A. The standard tine access openings 25 and narrow tine vertical openings 25A of one sidewall 18 are positioned to mirror the standard tine access openings 25 and narrow tine vertical openings 25A of the opposing sidewall 18 on the opposite side of the support deck 15 so that one standard lateral access channel 121A (FIG. 14) is formed by a first pair of mirrored standard tine access openings 25 while a second standard lateral access channel 121B (FIG. 14) is formed by a second pair of mirrored standard tine access openings 25.

In preferred embodiments, the pallet 100 comprises two narrow tine vertical openings 25A positioned relatively closer to the upper load contacting surface 16 when compared to standard tine access openings 25. Narrow tine vertical openings 25A are preferably configured to receive the narrow tines of warehouse material handling equipment comprising two relatively closer or narrowly spaced tines such a narrow pallet transporting devices 300 (FIG. 12) through narrow lateral access channels 122A or 122B (FIG. 14) within the pallet cavity 21 (FIG. 4). Narrow tine vertical openings 25A provide a means for the pallet 100 to accept a narrow pallet transporting device optionally comprising larger diameter wheels. Larger diameter wheels provide a more stable and safer means to transport the pallet 100 over uneven surfaces such as parking lots, curb breaks, thresholds, etc. In some embodiments, narrow tine vertical openings 25A have an approximate width between 2 and 6 inches and preferably about 4 inches while standard tine access openings 25 may have an average width of about 8-14 inches. In further embodiments, a first narrow lateral access channel 122A (FIG. 14) is formed through the pallet cavity 21 (FIG. 4) by a first narrow tine vertical opening 25A on a first sidewall 18 and a mirrored and opposing narrow tine vertical opening 25A on a second opposing sidewall 18. In yet further embodiments, a second narrow lateral access channel 122B (FIG. 14) is formed through the pallet cavity 21 (FIG. 4) by a second narrow tine vertical opening 25A on a first sidewall 18 and a mirrored and opposing narrow tine vertical opening 25A on a second opposing sidewall 18.

FIG. 4 depicts an elevation view showing the side of an example of an improved pallet 100 according to various embodiments. In this depiction, a tine support element 22 extends into the pallet cavity 21 formed by the two sidewalls 18, ground contacting legs 19, and the lower ground facing surface 17 of the support deck 15. In preferred embodiments, two or more tine support elements 22 extend into the pallet cavity 21 formed by the two sidewalls 18, ground contacting legs 19, and the lower ground facing surface 17 of the support deck 15. A longitudinal access channel may be formed and bounded at the top the lower ground facing surface 17 of support deck 15 and at both right and left sides by ground contacting leg 19, and the sidewalls 18. In preferred embodiments and as shown by example in FIG. 4, support element 22 comprises a longitudinal tine contacting surface 22A (FIGS. 2 and 5) with a center region located between the two sidewalls 18 preferably at or near the center of the pallet 100. In some embodiments, support element 22 comprises a longitudinal tine contacting surface 22A (FIGS. 2 and 5) with a center region located substantially equidistant between the two sidewalls 18.

The longitudinal access channel 120 (FIG. 14) is configured to accept one or more tines of a pallet transporting device. In some embodiments, two relatively narrow spaced tines from a narrow pallet transporting device 300 (FIG. 12) may be inserted into the longitudinal access channel 120 (FIG. 14) around both ends of a tine support element 22 so that the tines contact a portion of the lower ground facing surface 17. In other embodiments, a single tine from a traditional pallet transporting device 200 (FIG. 6) may be inserted into the longitudinal access channel 120 (FIG. 14) so that the tine contacts a portion of a longitudinal tine contacting surface 22A (FIG. 2) and/or a lateral tine contacting surface 22B (FIG. 2) on the tine support elements 22 in the pallet cavity 21.

Figure 5:
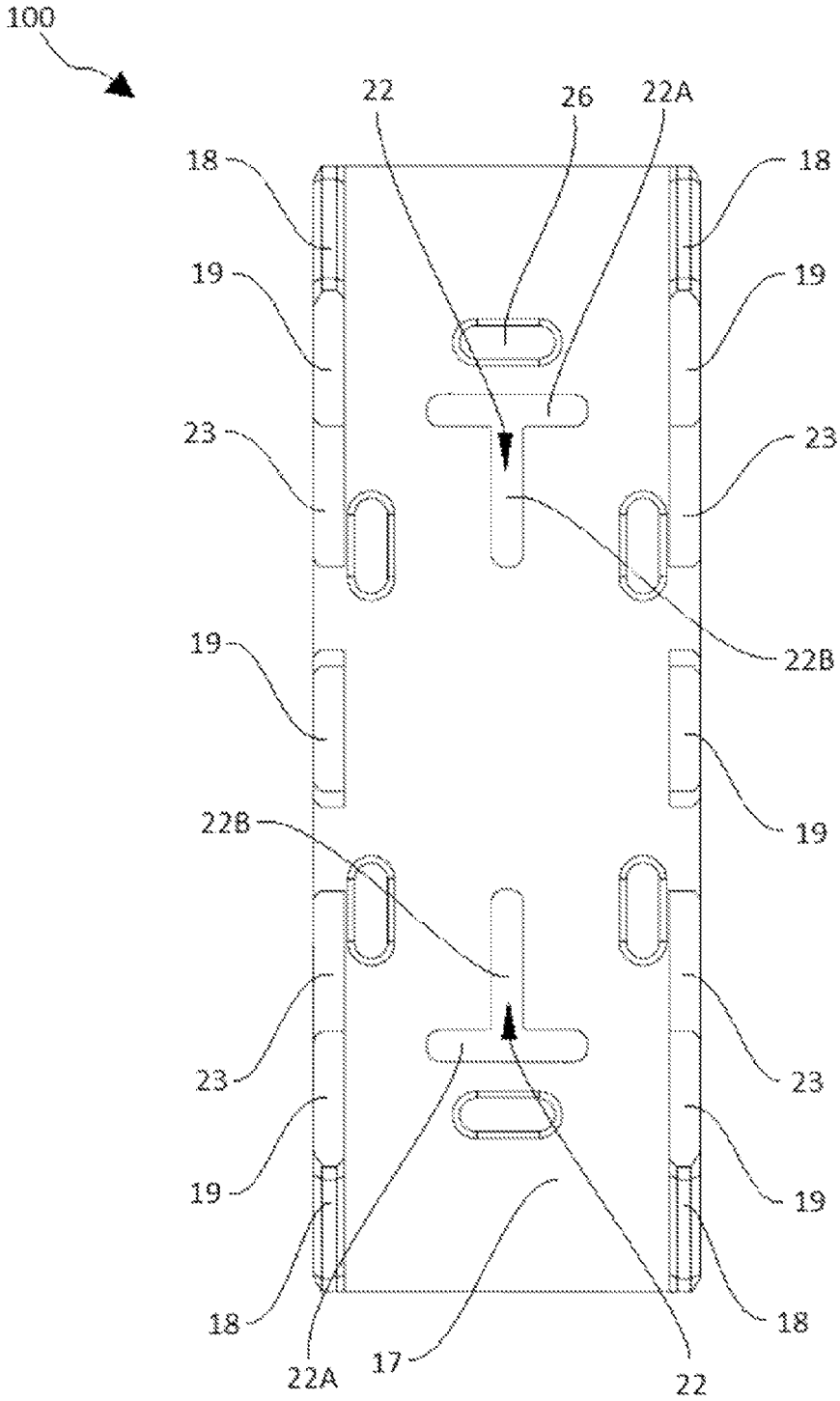
FIG. 5 illustrates a plan view of the bottom of an example of an improved pallet according to various embodiments described herein.

FIG. 5 illustrates a plan view of the bottom of an example of an improved pallet 100 according to various embodiments. In this embodiment, two tine support elements 22 are positioned on the lower ground facing surface 17. In other embodiments, one, three, or more tine support elements 22 may be positioned on the lower ground facing surface 17 and be configured to contact one or more tines of a pallet transporting device.

In this example and in preferred embodiments, the tine support elements 22 comprise a longitudinal tine contacting surface 22A and/or a lateral tine contacting surface 22B each protruding vertically down from the lower ground facing surface 17 and partially into the pallet cavity 21 (FIG. 4) but not below the ground contacting legs 19 of the sidewalls 18. Additionally, one or more longitudinal tine contacting surface 22A and/or a lateral tine contacting surface 22B of a support element 22 may be configured to protrude vertically down from the lower ground facing surface 17 the same distance into the pallet cavity 21 (FIG. 4) as to make their depth level or in the same plane as the two opposing and mirrored tine support edges 23 of the standard tine access openings 25 (FIG. 3) located on opposing sidewalls 18.

In some embodiments, one or more apertures 26 may be positioned throughout the support deck 15, sidewalls 18, or ground contacting legs 19 for use as handles, air vents, or other suitable purposes.

Figure 6:
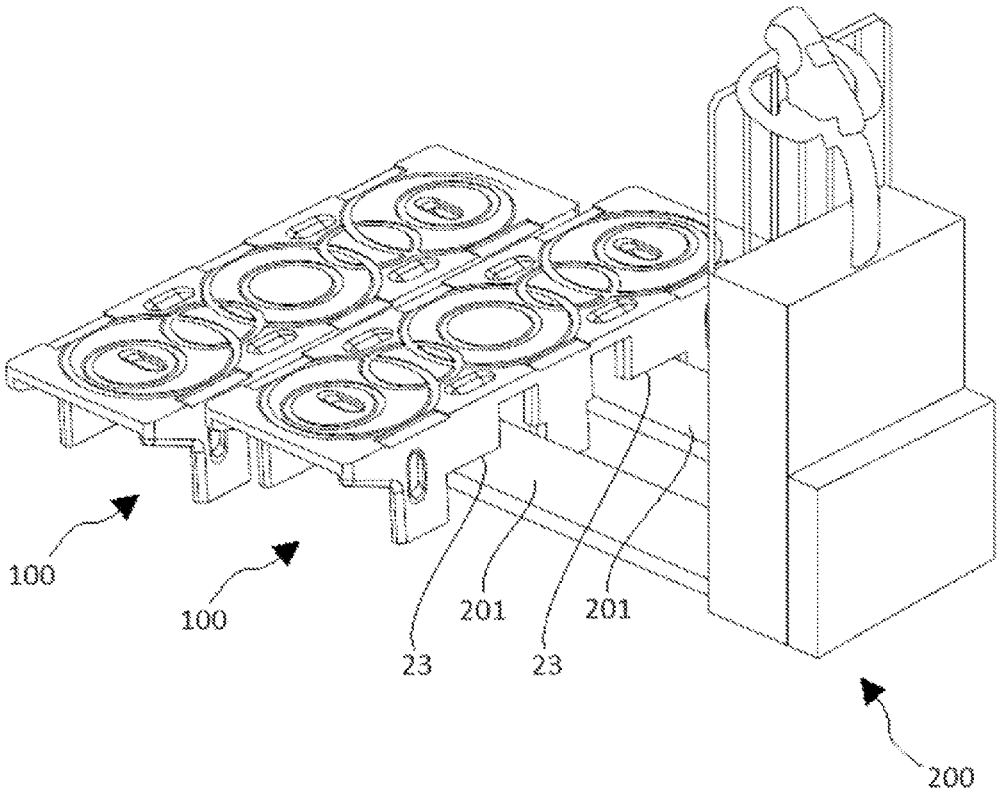
FIG. 6 shows a top perspective view of two examples of improved pallets and a traditional pallet transporting device according to various embodiments described herein.

Turning now to FIG. 6, a top perspective view of two examples of improved pallets 100 according to various embodiments are shown engaged to the standard horizontal industry standard tines 201 of a traditional pallet transporting device 200. In this embodiment, the industry standard tines 201 are inserted into the lateral standard tine access openings 25 (FIG. 3) and contacting the tine support edges 23 allowing a pallet 100 to be lifted and moved by the traditional pallet transporting device 200. In some embodiments, a traditional pallet transport device 200 shall generally mean pallet lifting equipment with tines that have a width of about 9 inches and are capable of lifting pallets to a height of about 9 inches off the ground although other types and designs of lifting equipment may be used as well.

Figure 7:
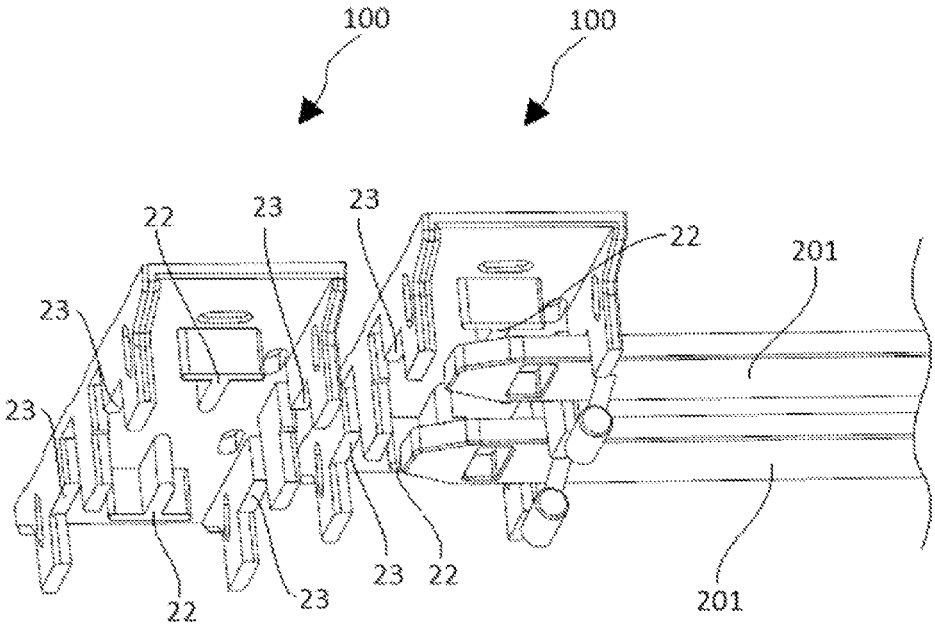
FIG. 7 depicts a bottom perspective view of two examples of improved pallets with one pallet partially engaged with two standard lift tines according to various embodiments described herein.

FIG. 7 depicts a bottom perspective view of two examples of improved pallets 100 according to various embodiments are shown engaged to the industry standard tines 201 of a traditional pallet transporting device 200 as shown in FIG. 6. The industry standard tines 201 are inserted into the standard tine access openings 25 (FIG. 3) and are shown making contact with the tine support elements 22 of a first pallet 100 (right side) allowing the pallets 100 to be lifted and moved by the traditional pallet transporting device 200 without causing the pallet 100 to flip or be positioned at an awkward angle which may cause damage to the pallet 100 or the contents (not shown) on the pallet deck 15 (FIGS. 1, 2, and 4). Of particular interest, because of its orientation, the lateral tine contacting surface 22B (FIG. 2) is transversely contacting a portion of the upper surface of the lift tine 201.

Figure 8:
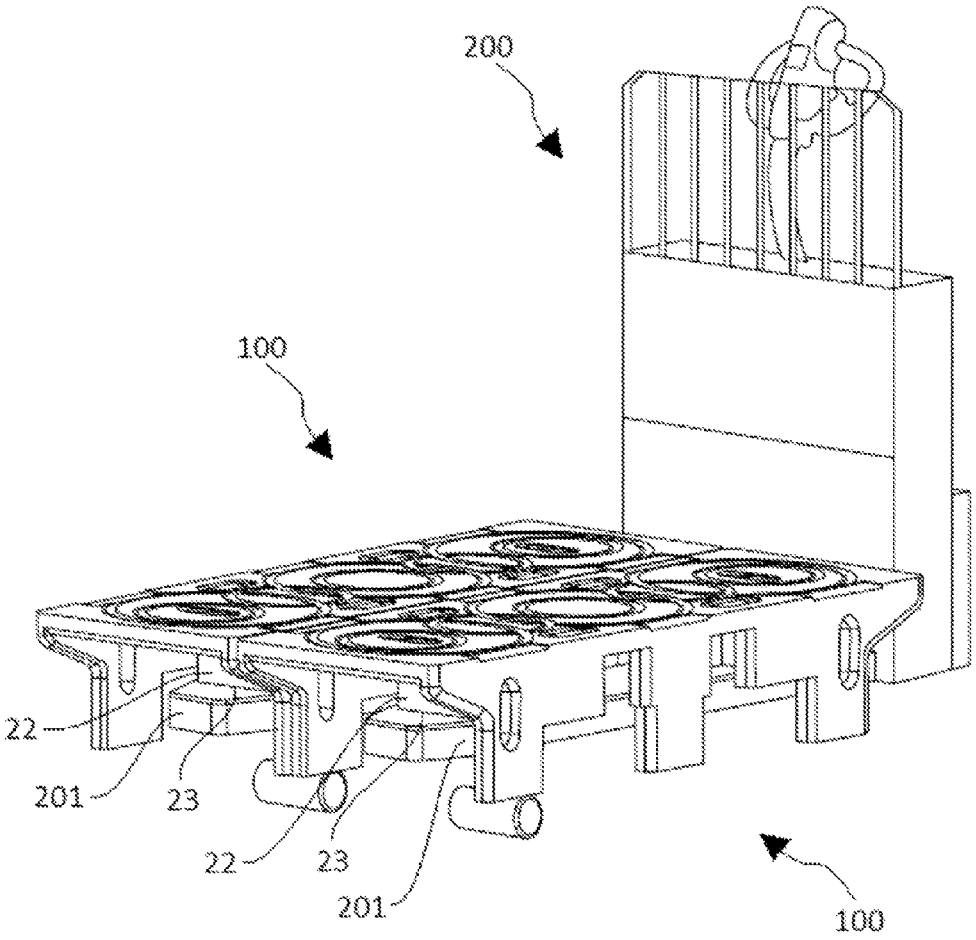
FIG. 8 illustrates top perspective view of two examples of improved pallets engaged with two standard tines of a traditional pallet transporting device according to various embodiments described herein.

FIG. 8 illustrates a top perspective view of two examples of improved pallets 100 according to various embodiments. In this example, two industry standard tines 201 of a traditional pallet transporting device 200 are inserted into the longitudinal access channel 120 (FIG. 14) of each pallet 100. Of particular interest, because of its orientation, the longitudinal tine contacting surfaces 22A (FIG. 2) are transversely contacting a portion of the upper surface of the lift tine 201.

Figure 9:
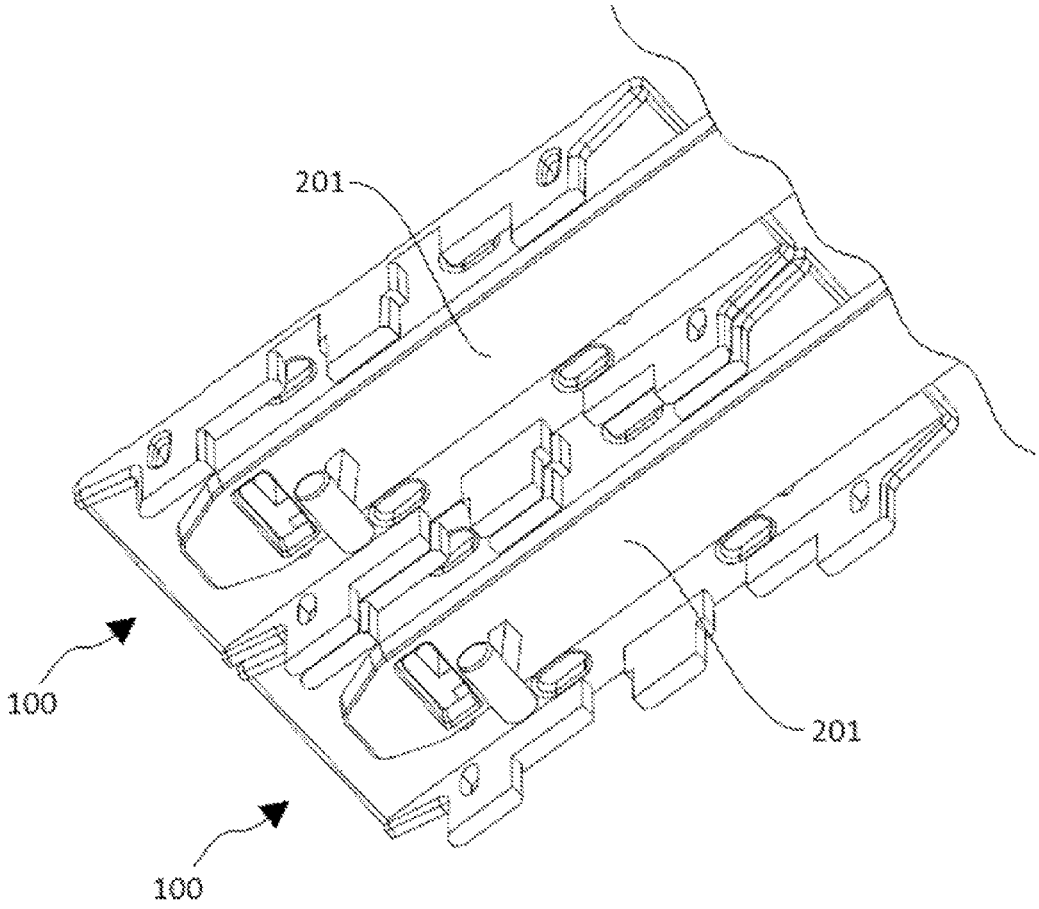
FIG. 9 shows a bottom perspective view of two examples of improved pallets engaged with two standard tines of a traditional pallet transporting device according to various embodiments described herein.

FIG. 9 illustrates a bottom perspective view of two examples of improved pallets 100 according to various embodiments are shown engaged to the industry standard tines 201 of a traditional pallet transporting device 200 as shown in FIG. 8. In this example, one industry standard tine 201 is inserted into the longitudinal access channel 120 (FIG. 14) of each pallet 100. Each industry standard tine 201 is engaging one or more tine support elements 22 (FIGS. 2, 4, 5, 7, and 8) of each pallet 100 allowing the traditional pallet transporting device 200 to lift and move two pallets 100 without the need for any attachments or adapters.

Figure 10:
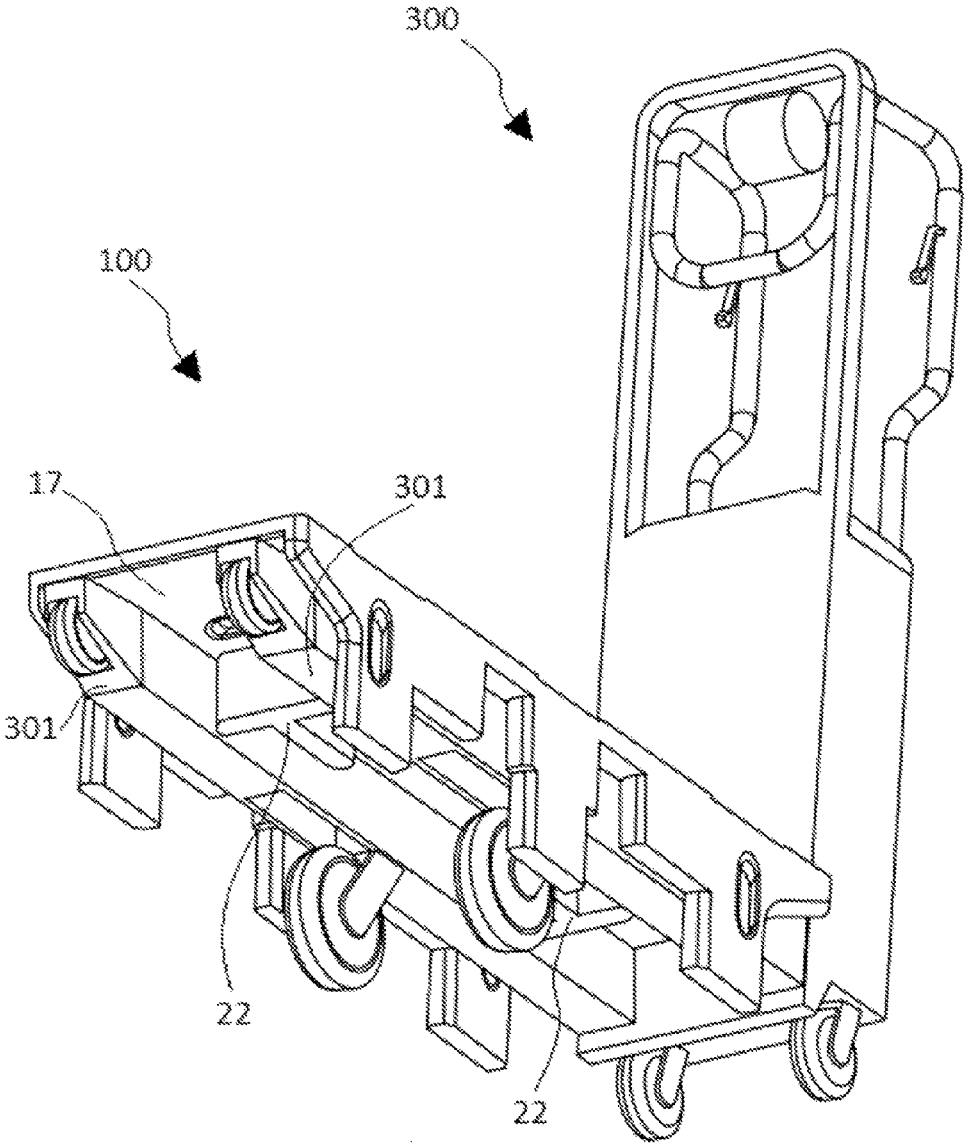
FIG. 10 depicts a bottom perspective view of an example of an improved pallet and a narrow pallet transporting device according to various embodiments described herein.

FIG. 10 depicts a bottom perspective view of an example of an improved pallet 100 according to various embodiments engaged to the vertical support tines 301 of a narrow pallet transporting device 300. In this example, the lower ground facing surface 17 is contacting the vertical support tines 301 which are inserted into the longitudinal access channel 120 (FIG. 14) and further into two narrow longitudinal access channels located on either side of support elements 22 of the pallet 100. Also depicted in this embodiment, the vertical support tines 301 are contacting and lifting the pallet 100 with the lower ground facing surface 17, but not lifting the pallet 100 by the support elements 22. In some alternative embodiments, the tine support elements 22 may extend to each sidewall 18 (FIGS. 1-5) (or substantially close to each sidewall 18) so that the vertical support tines 301 will contact the support elements 22, but not contact the lower ground facing surface 17 of the deck 15 (FIGS. 1, 2, and 4).

Figure 11:
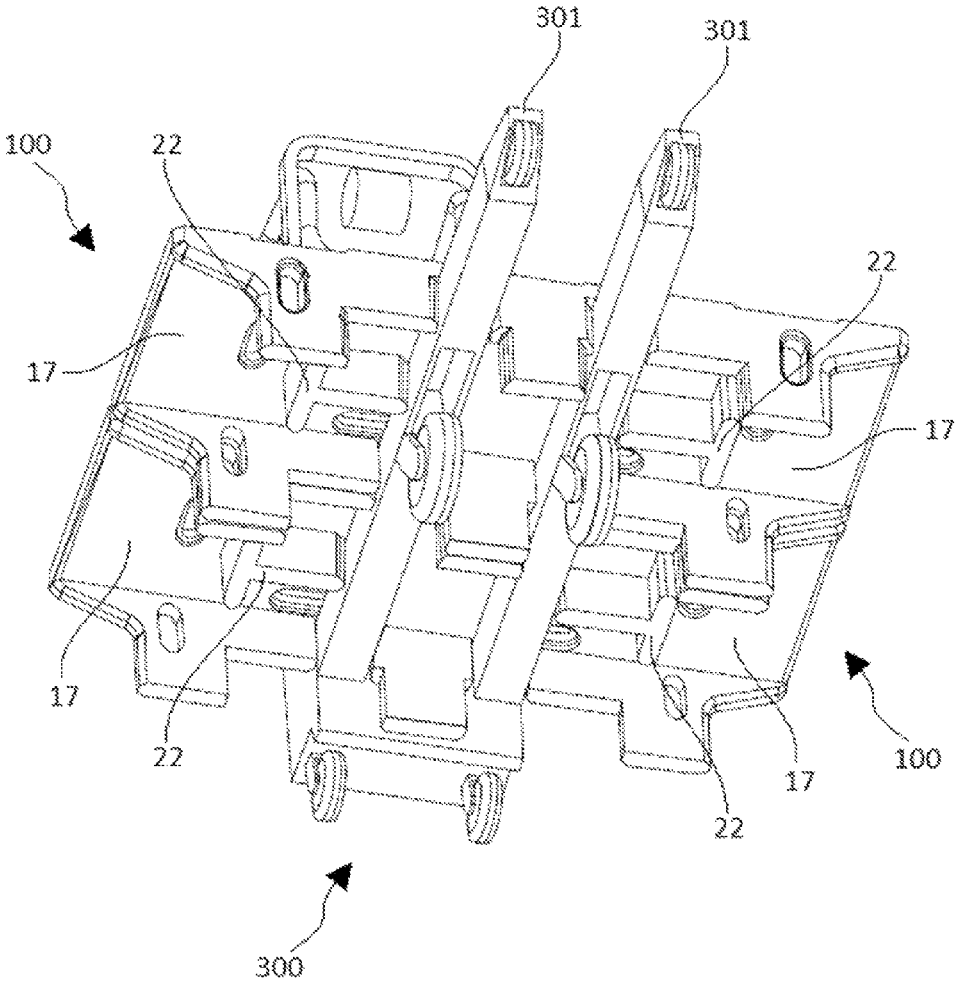
FIG. 11 illustrates a bottom perspective view showing two examples of improved pallets with two narrow vertical support tines engaged within narrow tine vertical openings on the lateral sides of the pallets in accordance with various embodiments described herein.

FIG. 11 illustrates a bottom perspective view of two examples of improved pallets 100 according to various embodiments engaged to the vertical support tines 301 of a narrow pallet transporting device 300. In this example, vertical support tines 301 are inserted into the two narrow tine vertical openings 25A (FIG. 3) on each sidewall 18 of the pallet 100 and are engaging with tine support edges 23 (FIGS. 1 and 2).

Figure 12:
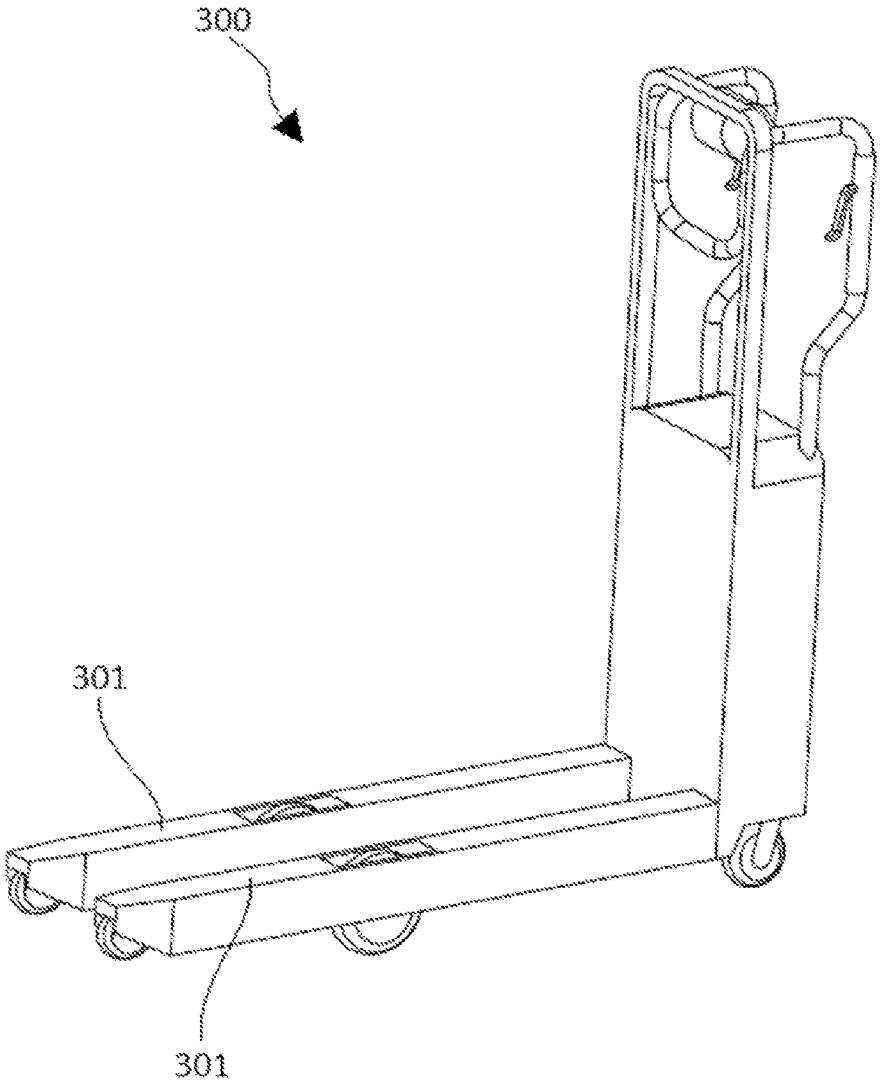
FIG. 12 shows a perspective view of an example of a narrow pallet transporting device for use with improved pallets according to various embodiments described herein.

FIG. 12 illustrates a perspective view of an example of a narrow tine pallet transporting device 300 for use with improved pallets 100 (FIGS. 1-11, 13-14) according to various embodiments described herein. The vertical support tines 301 of the narrow tine pallet transporting device 300 are configured to be spaced relatively closer together than the industry standard tines 201 of a traditional pallet transporting device 200 (FIGS. 6 and 8). The unique design of the narrow tine pallet transporting device 300 allows for the pallet 100 to be engaged from any side with the transporting device 300 for transport. Also, this unique design does not limit traditional pallet transporting devices 200 (FIGS. 6 and 8) from engaging the pallet 100 for transport. In some embodiments, the vertical support tines 301 of the narrow tine pallet transporting device 300 have a width of about 3-5 inches while standard lift tines (FIGS. 6-9) have a width of about 9 inches.

FIGS. 13A-D depict a plan view of the bottom of four examples of improved pallets 100 according to various embodiments described herein. It should be understood to one of ordinary skill in the art that the tine support elements 22 may be a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

Figure 13A:
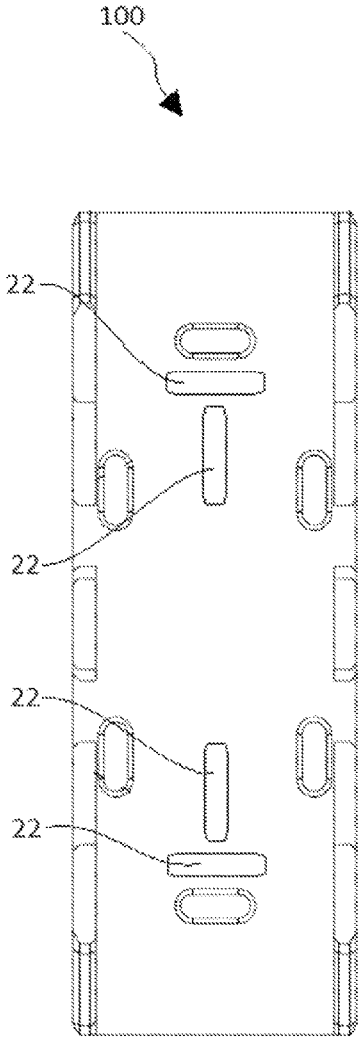
FIG. 13A depicts a plan view showing the bottom one example of an improved pallet with one type of tine support element in accordance with various embodiments described herein.
Figure 13B:
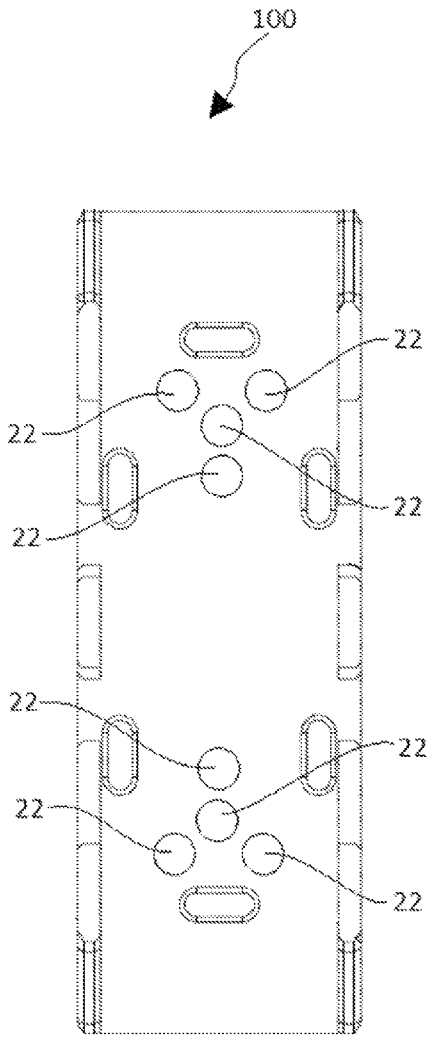
FIG. 13B depicts a plan view showing the bottom one example of an improved pallet with one type of tine support element in accordance with various embodiments described herein.
Figure 13C:
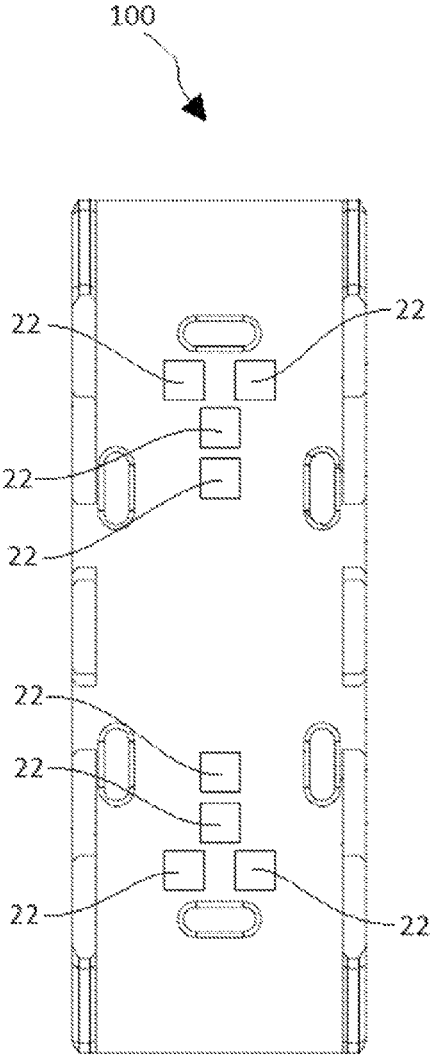
FIG. 13C depicts a plan view showing the bottom one example of an improved pallet with one type of tine support element in accordance with various embodiments described herein.
Figure 13D:
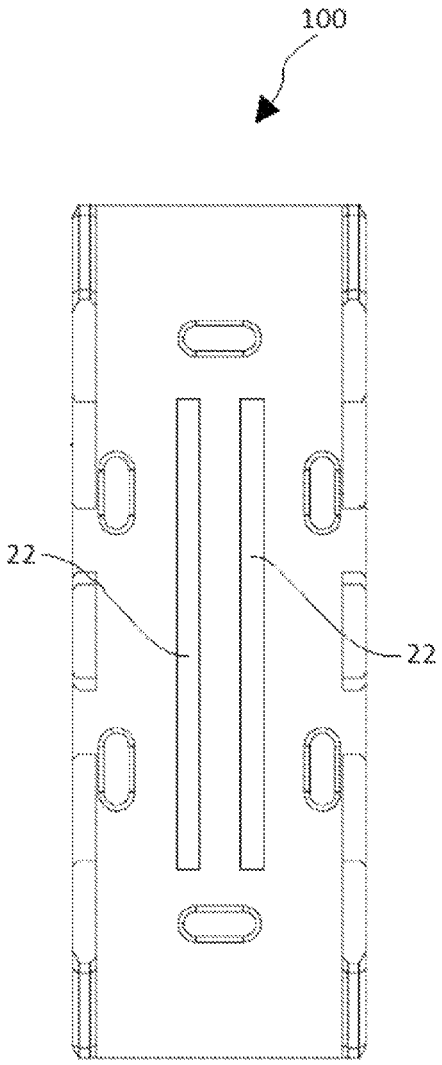
FIG. 13D depicts a plan view showing the bottom one example of an improved pallet with one type of tine support element in accordance with various embodiments described herein.

FIG. 13A shows a pallet 100 comprising four substantially cuboid shaped support elements 22. The pallet 100 illustrated in FIG. 13B comprises eight substantially cylindrical shaped support elements 22. Eight substantially cuboid shaped support elements 22 are depicted on the pallet 100 in FIG. 13C. A two large rectangular support elements 22 are shown on the embodiment of a pallet 100 illustrated in FIG. 13D. One skilled in the art will immediately recognize that a pallet 100 may comprise any number, size, and shape of support elements 22. In preferred embodiments, the size and dimensions of support elements 22 are sufficient as to not block or restrict tines from engaging narrow lateral access channels 122A and 122B (FIG. 14) formed by the two opposing narrow tine vertical openings 25A (FIG. 3) on each side wall 18 (FIGS. 1-5). Furthermore, in preferred embodiments, the size and dimensions of support elements 22 are sufficient as to not block or restrict the longitudinal tine access channels 120 (FIG. 14) from engaging the vertical support tines 301 (FIGS. 10-12) of narrow tine pallet transporting devices 300 when entering the pallet 100 cavity 21 (FIG. 4) from a longitudinal direction (FIG. 10).

Figure 14:
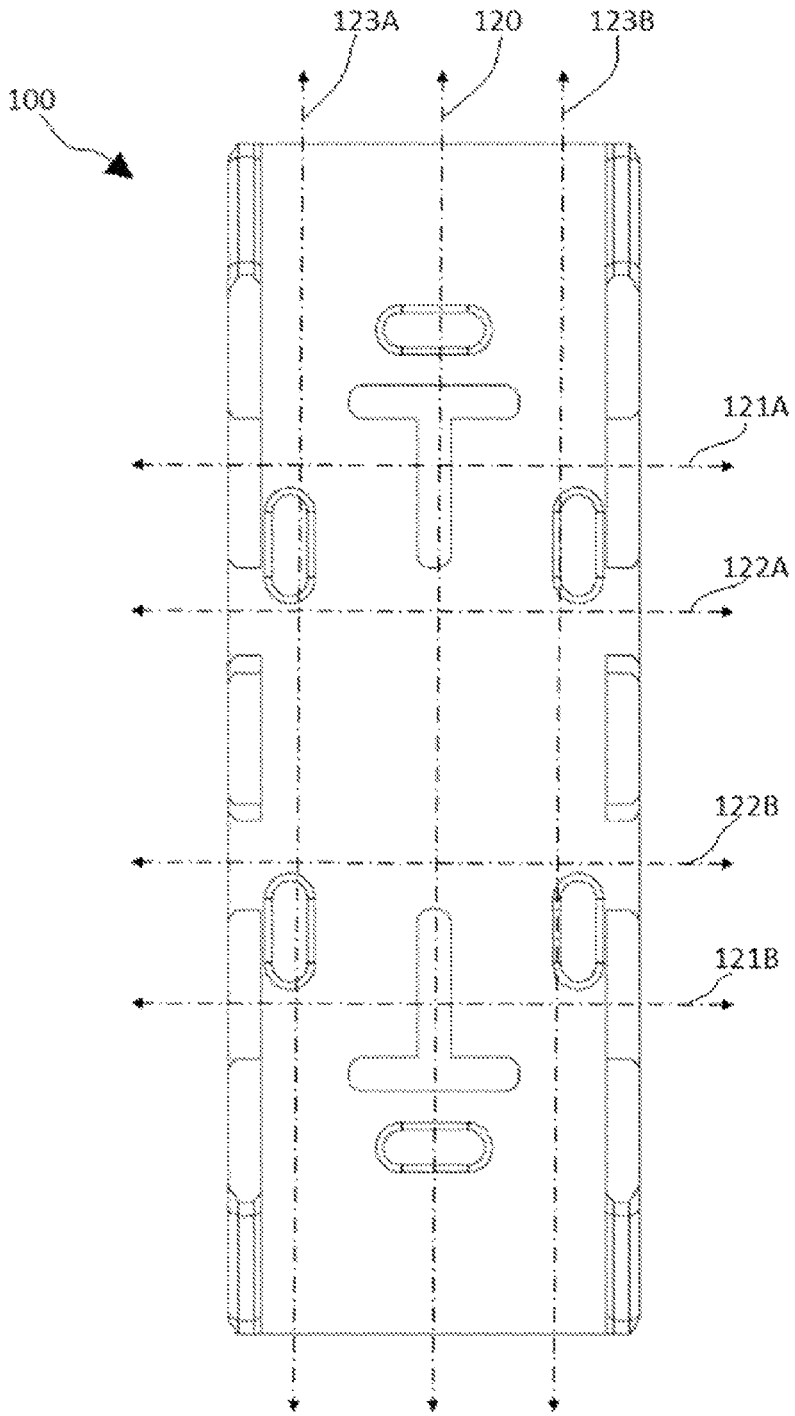
FIG. 14 illustrates plan view showing the bottom cavity of an improved pallet with various access channels marked with broken lines in accordance with various embodiments described herein.

FIG. 14 depicts a plan view of the bottom of an example of a pallet 100 according to various embodiments described herein. In this example the pallet 100 comprises a longitudinal access channel 120 (broken line), two standard lateral access channels 121A (broken line) and 121B (broken line), two narrow lateral access channels 122A (broken line) and 122B (broken line), and two narrow longitudinal access channels 123A (broken line) and 123B (broken line). In preferred embodiments, the longitudinal access channel 120 is configured to accept an industry standard tine 201 (FIGS. 6-9) from a traditional pallet transporting device 200 (FIGS. 6 and 8) through longitudinal tine access openings located on opposing longitudinal sides of the pallet 100 (top and bottom sides shown in FIG. 14) as well as accept two narrow vertical support tines 301 (FIG. 12). In preferred embodiments, two standard lateral access channels 121A and 121B are configured to accept two industry standard tines 201 (FIGS. 6-9) from a traditional pallet transporting device 200 (FIGS. 6 and 8) into the standard tine access openings 25 (FIG. 3). In preferred embodiments, a portion of the lateral tine contacting surface 22B of a tine support element 22 is located within the same plane as the first standard lateral access channel 121A and a portion of the lateral tine contacting surface 22B of a second support element 22 is located generally within the same plane as the second standard lateral access channel 121B. In preferred embodiments, narrow lateral access channels 122A and 122B are formed by two sets of opposing narrow tine vertical openings 25A (FIG. 3) located within opposing sidewalls 18 (FIG. 3) of pallet 100. Narrow lateral access channels 122A and 122B are configured to accept vertical support tines 301 (FIGS. 10-12) of a narrow pallet transporting device 300 (FIGS. 10-12). In some embodiments, support elements 22 and in particular tine contacting surfaces 22A and 22B are configured and designed as to not block tine movement through narrow lateral access channels 122A and 122B.

Still referring to FIG. 14, in some embodiments and in the example shown, the improved pallet 100 may further comprise a first narrow longitudinal access channel 123A and may also include a second narrow longitudinal access channel 123B. Narrow longitudinal access channel 123A or 123B are generally configured to each accept and receive one vertical support tine 301 (FIGS. 10-12) of a narrow pallet transporting device 300 (FIGS. 10-12) through the pallet cavity 21 (FIG. 4) in a longitudinal direction. In some embodiments, the narrow longitudinal access channels 123A and 123B are bordered on their outer perimeter by a side wall 18 (FIGS. 1-5) and at portions along their inner perimeter by the distal outside edges of support elements 22.

The elements that make up the pallet 100, support elements 22, sidewalls 18, support deck 15 or other components and features discussed herein may be made from durable materials such as hard plastics, metal alloys, wood, hard rubbers, carbon fiber, or any other suitable materials including combinations of materials. Additionally, one or more elements may be covered with durable and slightly flexible materials such as soft plastics, silicone, soft rubbers, or any other suitable materials including combinations of materials. In some embodiments, pallet 100 and support elements 22 may be integrally or uniformly formed out of plastic, rubber, or other suitable material.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An improved pallet, the pallet comprising:

a. a support deck with an upper load contacting surface and a lower ground facing surface;

b. a first sidewall with ground contacting legs connected to and extending below one side of the support deck c. a second sidewall with ground contacting legs connected to and extending below an opposing side of the support deck, the first sidewall comprising a tine support edge positioned below the ground facing surface of the support deck and located between ground contacting legs wherein the tine support edge forms a perimeter edge of a tine opening configured to accept the lift tine of a pallet transport device;

d. a pallet cavity formed below said lower ground facing surface of the support deck, the second sidewall comprising a tine support edge positioned below the ground facing surface of the support deck and located between ground contacting legs wherein the tine support edge forms a perimeter edge of a tine opening configured to accept the lift tine of a pallet transport device and located between said first and second sidewalls;

e. a first support element with a tine contacting surface located within the pallet cavity but not extending below the ground contacting legs of said first and second sidewalls;

f. a second support element with a tine contacting surface spaced apart from said first support element located within the pallet cavity but not extending below the ground contacting legs of said first and second sidewalls; and wherein said first support element said second support element and said tine support edge, are configured to act as contact points for a lift tine of a pallet transport device when engaging the pallet in a vertical lifting motion.

2. The pallet according to claim 1 wherein:

a. said first support element with a tine contacting surface protrudes vertically down from the lower ground facing surface of the support deck partially into the pallet cavity; and b. said second support element with a tine contacting surface spaced apart from said first support element and protrudes vertically down from the lower ground facing surface of the support deck partially into the pallet cavity.

3. The pallet according to claim 1 further comprising a first and second longitudinal tine access opening on opposing ends of the pallet adjacent to the first and second sidewalls, said first and second longitudinal tine access openings forming a longitudinal access channel configured to accept a lift tine through the pallet cavity in a longitudinal direction and wherein said first and said second support elements are located between said first sidewall and said second sidewall within the pallet cavity and along the longitudinal access channel.

4. The pallet according to claim 3 wherein said first and second support elements have a longitudinal tine contacting surface oriented to provide a surface configured to transversely contact a portion of a lift tine entering the pallet through the longitudinal access channel.

5. The pallet according to claim 4 further comprising opposing first and second tine openings located within said first sidewall and second sidewall; wherein opposing first and second tine openings form a first lateral access channel and a second standard lateral access channel, wherein each standard lateral access channel is configured to accept lift tines of a pallet transporting device through the pallet cavity.

6. The pallet according to claim 5 wherein said first and second support elements have a lateral tine contacting surface oriented to provide a surface configured to transversely contact a portion of a lift tine entering the pallet through a lateral access channel.

7. The pallet according to claim 6 wherein a portion of the lateral tine contacting surface of first support element is located in and along the same plane of the first lateral access channel; and a portion of the lateral tine contacting surface of the second support element is located in and along the same plane of the second lateral access channel.

8. The pallet according to claim 7 wherein the lateral tine contacting surface of said first and said second support elements extends vertically down into the pallet cavity to a depth substantially level with the tine support edge located within a sidewall.

9. The pallet according to claim 8 wherein the tine support edges forms the upper side of the tine opening located within a sidewall and a chamfered edge forms one lateral side of the tine openings.

10. The pallet according to claim 1 further comprising opposing first and second tine openings located within said first sidewall and second sidewall, wherein opposing first and second tine openings form a first lateral access channel and a second lateral access channel with each lateral access channel configured to accept lift tines of a pallet transporting device through the pallet cavity.

11. The pallet according to claim 10 wherein said first and second support elements have a lateral tine contacting surface oriented to provide a surface configured to contact a portion of a lift tine entering the pallet through the a lateral access channel.

12. The pallet according to claim 11 wherein a portion of the lateral tine contacting surface of first support element is located within the same plane as the first lateral access channel, and a portion of the lateral tine contacting surface of the second support element is located generally within the same plane as the second lateral access channel.

13. The pallet according to claim 12 wherein the lateral tine contacting surface of said first and second support elements extends vertically down into the pallet cavity to a depth substantially level with the tine supporting edge.

14. The pallet according to claim 1 wherein said first and second support elements comprise a longitudinal tine contacting surface oriented to provide a surface sufficient to contact a portion of a lift tine entering the pallet from a longitudinal direction and said first and second support elements have a lateral tine contacting surface oriented to provide a surface sufficient to contact a portion of a lift tine entering the pallet from a lateral direction.

15. The pallet according to claim 14 wherein said lateral tine contacting surface and said longitudinal tine contacting surface are oriented to each other at approximate right angles.

16. The pallet according to claim 15 wherein said lateral tine contacting surface and said longitudinal tine contacting surface form a substantially T shaped or X shaped support element.

17. The pallet according to claim 1 wherein said first sidewall comprises a first set of two tine openings and a second set of two tine openings located proximate to said first set of two tine openings and said second sidewall comprises a first set of two tine openings and a second set of two tine openings located proximate to said first set of two tine openings.

18. The pallet according to claim 17 wherein the first support element extends vertically down into the pallet cavity and comprises a lateral tine contacting surface and a longitudinal tine contacting surface; and wherein the second support element extends vertically down into the pallet cavity and comprises a lateral tine contacting surface and a longitudinal tine contacting surface.

19. An improved pallet, the pallet comprising:

a. a support deck with an upper load contacting surface and a lower ground facing surface;

b. a first sidewall with ground contacting legs connected to one elongate side of the support deck and comprising a first set of two tine openings and a second set of two tine openings located proximate to said first set of two openings;

c. a second sidewall with ground contacting legs connected to an opposing elongate side of the support deck and comprising a first set of two tine openings and a second set of two tine openings located proximate to said first set of two openings;

d. a pallet cavity formed below said lower ground facing surface of the support deck and between said first and second sidewalls; and wherein the first set of two tine openings on the first and second sidewalls are configured to accept lift tines of a pallet transporting device and wherein the second set of two tine openings located proximate to said first set of two tine openings on the first and second sidewalls are configured to accept lift tines of a pallet transporting device.

20. The pallet according to claim 19 further comprising:

a. a first support element with a tine contacting surface located in the pallet cavity but not extending below said ground contacting legs of said first and second sidewalls;

b. a second support element with a tine contacting surface spaced apart from said first support element and located in the pallet cavity but not extending below said ground contacting legs of said first and second sidewalls; and wherein said first support element and said second support element are configured to act as contact point for a lift tine of a pallet transport device when engaging the pallet in a vertical lifting motion.

* * * * *

UNITED STATES PATENT AND TRADEMARK OFFICE

CERTIFICATE OF CORRECTION

PATENT NO. : 8,776,697 B1
APPLICATION NO. : 14/218161
DATED : July 15, 2014
INVENTOR(S) : Brian O'Connell It is certified that error appears in the above-identified patent and that said Letters Patent is hereby corrected as shown below:

In the Claims

In column 11, line 6 (Claim 1) replace "deck" with --deck, the first sidewall comprising a tine support edge positioned below the ground facing surface of the support deck and located between ground contacting legs wherein the tine support edge forms a perimeter edge of a tine opening configured to accept the lift tine of a pallet transport device;--

In column 11, line 9 (Claim 1) replace "first" with --second--

In column 11, lines 16-21 (Claim 1) delete "the second sidewall comprising a tine support edge positioned below the ground facing surface of the support deck and located between ground contacting legs wherein the tine support edge forms a perimeter edge of a tine opening configured to accept the lift tine of a pallet transport device"

In column 11, line 65-66 (Claim 5) delete "standard" both occurrences

Signed and Sealed this
Seventh Day of October, 2014

Michelle K. Lee

Michelle K. Lee
*Deputy Director of the United States Patent and Trademark Office*